US006460748B1

(12) United States Patent
Boschi

(10) Patent No.: US 6,460,748 B1
(45) Date of Patent: Oct. 8, 2002

(54) DEVICE FOR ADJUSTING THE TRANSVERSE POSITION OF A STRIP OF PACKAGING MATERIAL

(75) Inventor: Alessandro Boschi, Gualtieri (IT)

(73) Assignee: Tetra Laval Holdings & Finance S.A, Pully (CH)

( * ) Notice: Subject to any disclaimer, the term of this patent is extended or adjusted under 35 U.S.C. 154(b) by 0 days.

(21) Appl. No.: 09/715,018

(22) Filed: Nov. 20, 2000

(30) Foreign Application Priority Data

Jan. 31, 2000 (EP) ..... 00830070

(51) Int. Cl.[7] ..... B65H 43/08; B23Q 15/013
(52) U.S. Cl. ..... 226/20; 226/16; 226/45
(58) Field of Search ..... 226/18, 19, 20, 226/17, 16, 45, 3

(56) References Cited

U.S. PATENT DOCUMENTS

| | | | | |
|---|---|---|---|---|
| 2,078,669 A | * | 4/1937 | King | 226/20 X |
| 2,220,736 A | * | 11/1940 | Stockbarger et al. | 226/16 X |
| 3,317,101 A | * | 5/1967 | Himrod et al. | 226/19 |
| 3,368,726 A | * | 2/1968 | Funk et al. | 226/17 |
| 3,592,372 A | | 7/1971 | James et al. | |
| 3,680,446 A | * | 8/1972 | James et al. | 493/9 |
| 3,786,974 A | * | 1/1974 | Kron | 226/19 |
| 4,805,892 A | * | 2/1989 | Calhoun | 226/20 X |
| 5,098,507 A | * | 3/1992 | Mao | 226/19 X |
| 5,769,298 A | * | 6/1998 | Plumb | 226/19 |
| 6,269,995 B1 | * | 8/2001 | Rich et al. | 226/17 |

FOREIGN PATENT DOCUMENTS

| | | |
|---|---|---|
| EP | 0307125 A | 3/1989 |
| EP | 0618136 A | 10/1994 |

OTHER PUBLICATIONS

European Search Report dated Aug. 15, 2000.

* cited by examiner

*Primary Examiner*—Michael R. Mansen
*Assistant Examiner*—Minh-Chau Pham
(74) *Attorney, Agent, or Firm*—Burns, Doane, Swecker & Mathis, L.L.P.

(57) ABSTRACT

A device for adjusting the transverse position of a strip of packaging material on a packaging machine for producing packages containing a pourable food product, the device having a slide movable crosswise with respect to the strip and carrying a gripping member for moving the strip transversely; and a system for automatically adjusting the position of the slide in response to signals generated by optical sensors for detecting respective limit positions of the strip.

5 Claims, 4 Drawing Sheets

40
41
5
42
d 7
40
41
S1
S2
42
5
5
5
6a
P
A
B
29
14
34
12
6b
2
4a
4b
30
13
10
3
11
1
S5
8
TT

DEVICE FOR ADJUSTING THE TRANSVERSE POSITION OF A STRIP OF PACKAGING MATERIAL

This application claims priority under 35 U.S.C. §§119 and/or 365 to Appln. No. 00830070.9 filed in Europe on Jan. 31, 2000; the entire content of which is hereby incorporated by reference.

BACKGROUND OF THE INVENTION

The present invention relates to a device for adjusting the transverse position of a strip of packaging material on a machine for packaging pourable food products.

Machines for packaging pourable food products, such as fruit juice, wine, tomato sauce, pasteurized or long-storage (UHT) milk, etc., are known, in which the packages are formed from a continuous tube of packaging material defined by a longitudinally sealed strip.

The packaging material has a multilayer structure comprising a layer of paper material covered on both sides with layers of heat-seal material, e.g. polyethylene, and, in the case of aseptic packages for long-storage products, such as UHT milk, also comprises a layer of barrier material defined, for example, by an aluminium film, which is superimposed on a layer of heat-seal plastic material and is in turn covered with another layer of heat-seal plastic material eventually defining the inner face of the package contacting the food product.

To produce aseptic packages, the strip of packaging material is unwound off a reel and fed through an aseptic chamber, in which it is sterilized, for example, by applying a sterilizing agent, such as hydrogen peroxide, which is later evaporated by heating, and/or by subjecting the packaging material to radiation of an appropriate wavelength and intensity, and the sterilized strip is folded into a cylinder and sealed longitudinally to form, in known manner, a continuous vertical longitudinally sealed tube. In other words, the tube of packaging material forms an extension of the aseptic chamber, and is filled continuously with the pourable food product and then sent to a forming and (transverse) sealing unit for forming the individual packages and in which the tube is gripped between pairs of jaws to seal the tube transversely and form pillow packs, which are then separated by cutting the sealed portions between the packs.

The pillow packs are then fed to a final folding station where they are folded mechanically into the finished shape.

On known packaging machines of the type briefly described above, the strip of packaging material, before being folded into a tube, is fed along a path defined by pairs of cylindrical, powered or idle rollers extending across the full width of the strip, but which do not guide the strip transversely.

The transverse position of the strip is defined by manually adjusted guide devices comprising a pair of rollers cooperating on opposite sides with a longitudinal portion, close to the edge, of the strip, and carried by a slide movable along a guide in a direction parallel to the strip feed plane and perpendicular to the strip feed direction.

Any error in the transverse position of the strip—which may occur, for example, after splicing two reels or in the event the strip deviates laterally as opposed to being perfectly straight—may result in faulty packages.

When a fault is detected, e.g. by inspecting the packages coming off the machine, the error is correctable by manually adjusting the guide device. The time taken, however, to stop the machine, make the manual adjustment and restart the machine results in a considerable loss in production, both in terms of downtime and the packages rejected.

SUMMARY OF THE INVENTION

It is an object of the present invention to provide a device for adjusting the transverse position of the strip of packaging material, designed to eliminate the aforementioned drawbacks typically associated with known devices.

According to the present invention, there is provided a device for adjusting the transverse position of a strip of packaging material on a packaging machine for producing packages containing a pourable food product, the device comprising:

a slide movable in a first direction parallel to a feed plane of said strip and substantially perpendicular to a feed direction of said strip in said plane;

gripping means carried by said slide and for gripping in sliding manner an edge of said strip; and adjusting means for adjusting the position of said slide in said first direction;

characterized in that said adjusting means comprise an actuator for controlling said slide; a first sensor for detecting a first limit position of said strip and generating a first signal; a second sensor for detecting a second limit position of said strip and generating a second signal; and a control unit connected to said first and said second sensor, and which controls said actuator to move said slide towards said second limit position of said strip in response to a value of said first signal indicating said first limit position of said strip has been exceeded, and towards said first limit position of said strip in response to a value of said second signal indicating said second limit position of said strip has been exceeded.

BRIEF DESCRIPTION OF THE DRAWINGS

A preferred, non-limiting embodiment of the present invention will be described by way of example with reference to the accompanying drawings, in which.

DETAILED DESCRIPTION OF THE INVENTION

Figures 1A, 1B:
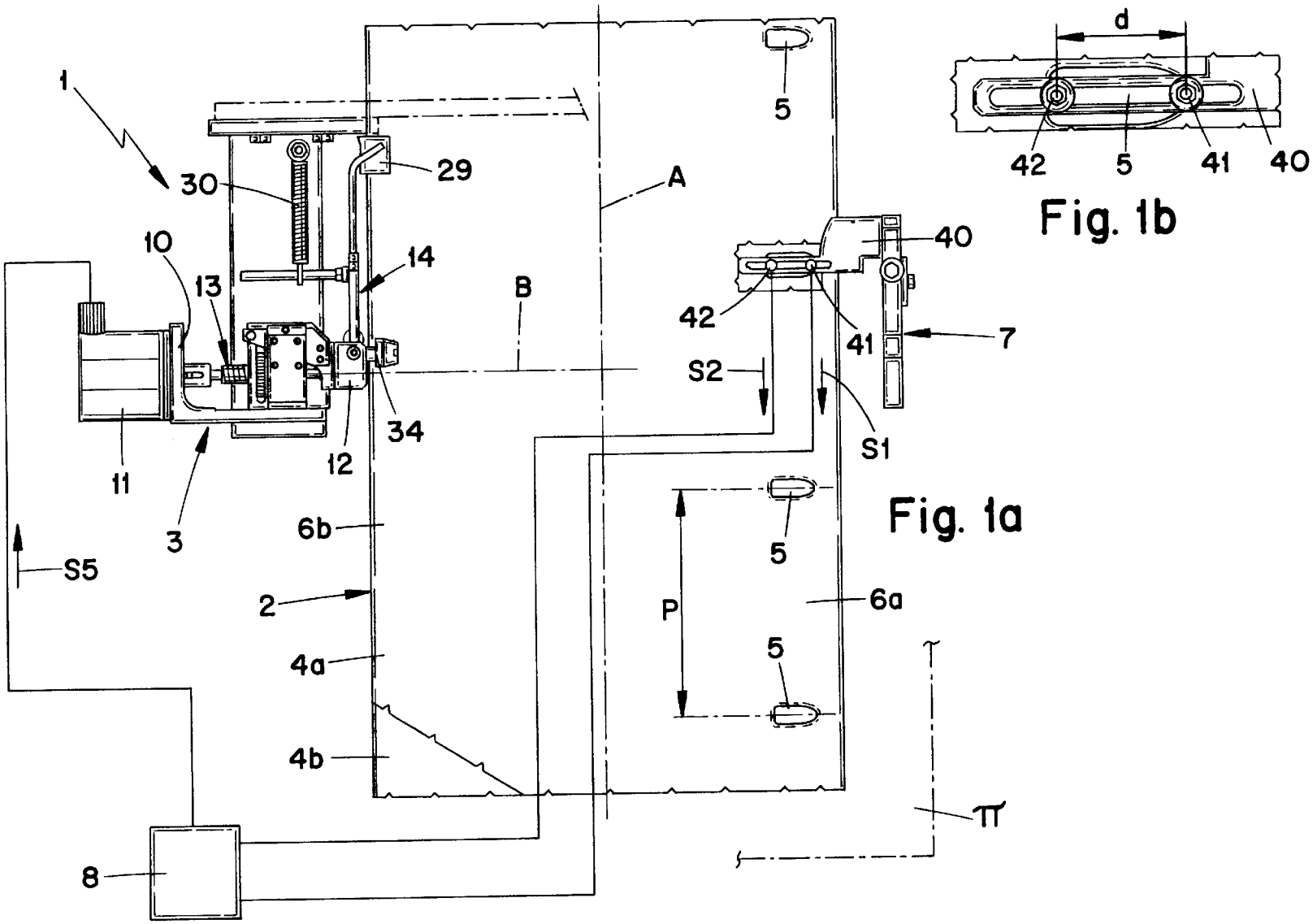
FIGS. 1*a* and 1*b* show a front view of a device for adjusting the transverse position of a strip of packaging material in accordance with the present invention, and an enlarged view of the support structure with the two optical sensors, respectively.
Figure 3:
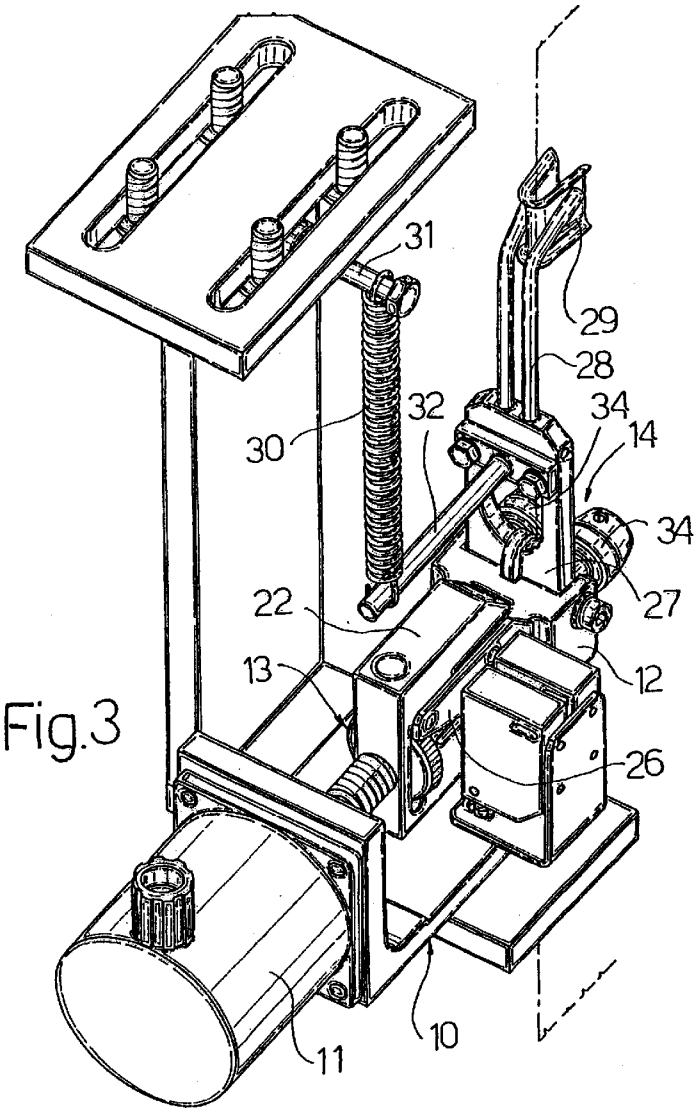
FIGS. 2 and 3 show a front view and a view in perspective respectively of a detail in FIG. 1.
Figure 2:
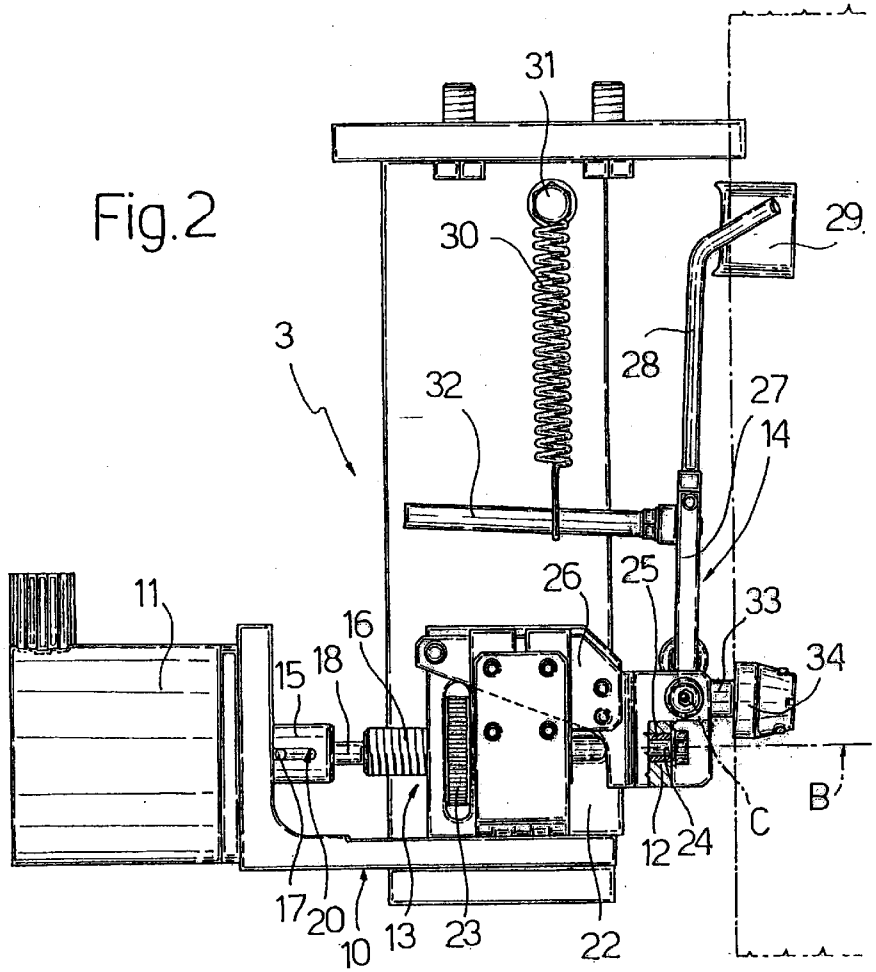

Number 1 in FIGS. 1 to 3 indicates as a whole a device for adjusting the transverse position of a strip of packaging material on a packaging machine (not shown) for producing packages containing a pourable food product, such as pasteurized or UHT milk, fruit juice, wine, etc.

More specifically, the machine is designed to produce aseptic sealed packages, containing a pourable food product, from a tube of packaging material formed by longitudinally folding and sealing a strip 2 of heat-seal sheet packaging material.

The material conveniently comprises a layer 4*a* of paper material, and a layer 4*b* of barrier material defined, for example, by a sheet of aluminium; and the above two layers are fixed to each other by an intermediate layer (not shown) of thermoplastic material, e.g. polyethylene, and are covered on opposite faces with further layers of polyethylene (not shown). Layer 4*a* of paper material conveniently comprises a succession of holes 5 formed prior to lamination, and at which layer 4*b* is whole, to enable subsequent application of pull-off or other types of opening devices (not shown), while at the same time ensuring the package remains whole and aseptic until opened. Holes 5 are located close to a longitudinal edge 6*a* of strip 2, and are equally spaced with a spacing p equal to the length of the portion of strip 2 required to produce each package.

Strip 2 is unwound off a reel (not shown) and is fed through the machine along a path defined by numbers of pairs of drive or transmission rollers (not shown). Device 1 is assigned to a vertical portion of the feed path of strip 2; in FIG. 1, $\pi$ indicates the feed plane of strip 2, and A the (vertical) feed direction of the strip; and, in the example shown, strip 2 travels downwards in steps, with stops of, for example, 120 ms between successive steps.

Device 1 substantially comprises a regulating and guide assembly 3 located close to a longitudinal edge 6*b,* opposite edge 6*a,* of strip 2; an assembly 7 for detecting the transverse position of the strip; and a control unit 8.

More specifically, assembly 3 (FIGS. 2 and 3) comprises a supporting structure 10 fixed to the frame (not shown) of the machine; an electric step motor 11 fixed to structure 10; and a slide 12 controlled by motor 11 via a transmission mechanism 13, and which slides in a direction B lying in plane $\pi$ and perpendicular to direction A. The slide carries a gripping member 14—described in detail later on—for gripping in sliding manner and moving strip 2 in direction B.

More specifically, motor 11 has an output shaft 15 having an axis parallel to direction B; and transmission mechanism 13 substantially comprises a screw 16 coaxial with and connected prismatically to the shaft, i.e. so as to be rotated by, but to slide axially and freely with respect to, shaft 15. Screw 16 and shaft 15 are connected, for example, by a radial pin 17 carried by a nonthreaded end 18 of the screw housed in sliding manner inside an axial cavity (not shown) of shaft 15; and the ends of pin 17 engage in sliding manner respective diametrically-opposite longitudinal slots 20 (only one shown in FIG. 2) on shaft 15.

Screw 16 is fitted through a guide member 22 fixed to structure 10, and is screwed through a nut screw 23 fixed to guide member 22, so that rotation of shaft 15, and hence of screw 16, results in axial displacement of the screw.

The end 24 of screw 16 opposite end 18 is connected in angularly-free, axially-fixed manner to slide 12, e.g. by means of a thrust bearing 25, so that axial displacement of screw 16 is transmitted to slide 12 and by slide 12 to strip 2 via gripping member 14. Slide 12 is connected prismatically to guide member 22 by two lateral plates 26 fixed to the slide and sliding along opposite lateral faces of guide member 22.

Gripping member 14 substantially comprises a supporting plate 27 hinged, close to its own bottom end, to slide 12 about an axis C perpendicular to directions A and B. The opposite end of the plate is fitted with an arm 28 supporting on the free end a fork-shaped guide shoe 29 having a substantially V-shaped section and cooperating, in use, with edge 6*b* of strip 2. Gripping member 14 is subjected to the elastic action of a low-stiffness spring 30 stretched between a fastening member 31 to structure 10, and an auxiliary arm 32 projecting transversely from plate 27. The elastic force exerted by spring 30 is low, and serves solely to hold shoe 29 in contact with strip 2 and so prevent in-service oscillation of member 14. Plate 27 supports two shafts 33 having axes parallel to each other, perpendicular to plate 27 and incident with respect to axis C, and which are fitted with respective idle rollers 34 rolling on opposite sides of strip 2. The distance between the axes of shafts 33 is conveniently adjustable to vary the contact pressure between rollers 34 and the material defining strip 2.

In actual use, gripping member 14 is tilted forwards, as shown in FIG. 2, in a position defined by a balance between the action of spring 30, the reaction of strip 2 on shoe 29, and the frictional force between the moving strip 2 and rollers 34. As said frictional force increases alongside an increase in the contact pressure between rollers 34 and strip 2, the inclination of gripping member 14 also increases accordingly.

With reference to FIG. 1, assembly 7 for detecting the transverse position of the strip comprises a supporting structure 40 fixed to the machine frame and fitted with two optical, e.g. optical-fiber, sensors 41, 42 (see enlarged detail), which are positioned facing the portion of strip 2 with holes 5, and are located at the point at which the holes are arrested as strip 2 is fed forward in steps.

More specifically, sensors 41, 42 are separated, crosswise with respect to strip 2, by a distance d slightly less than the transverse dimension of holes 5, so as to "read" the holes close to respective opposite ends.

Figure 4:
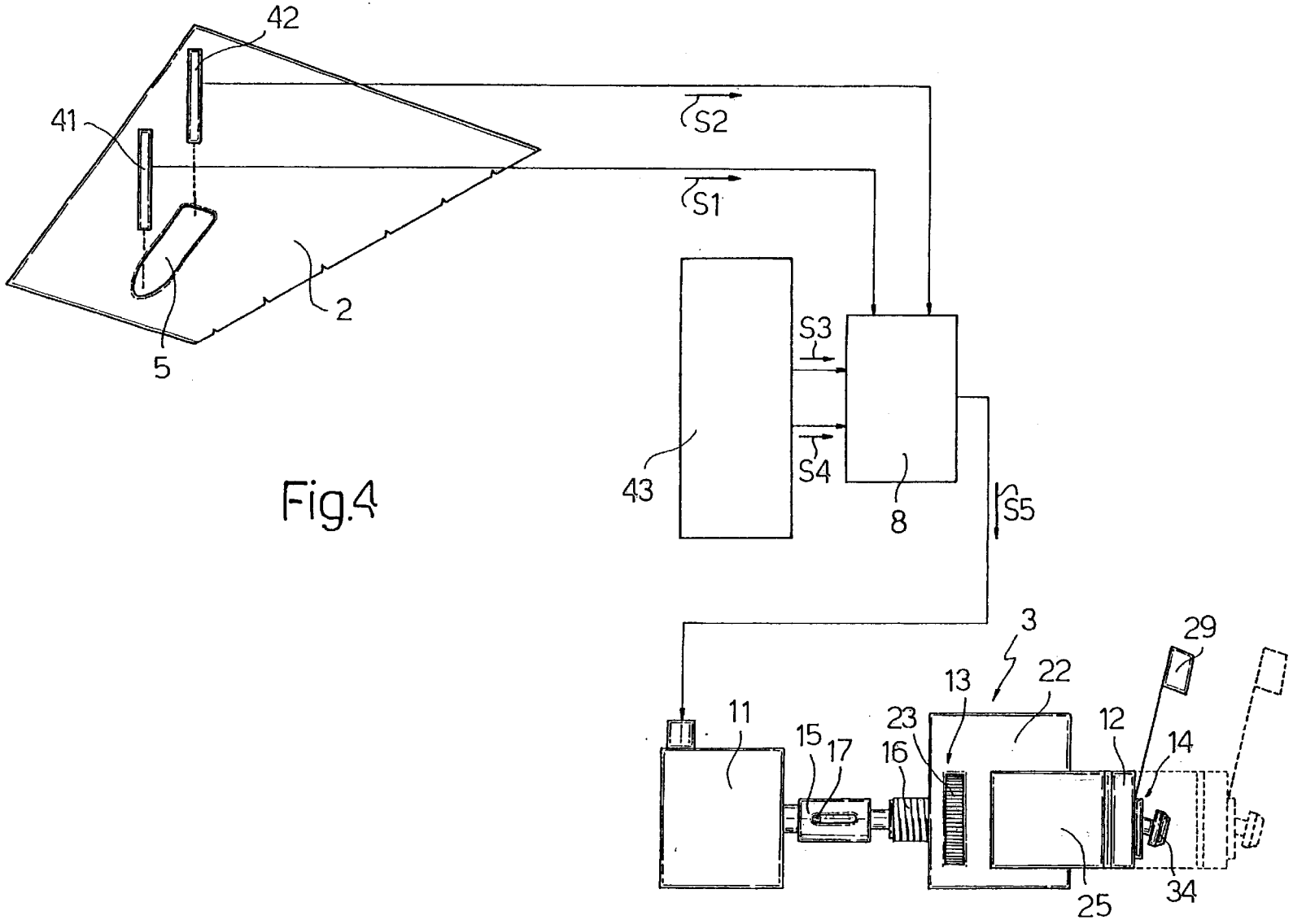
FIG. 4 shows, schematically, a control system of the FIG. 1 device.

Sensors 41, 42 generate respective signals s1, s2, which, appropriately amplified by respective amplifiers not shown, are supplied to control unit 8 (FIG. 4). Signals s1, s2 assume different states, depending on whether the respective sensor 41, 42 is positioned facing the inner portion of the hole (i.e. layer 4*b* of aluminium material) or an outer edge of the hole (i.e. layer 4*a* of paper material), so that sensors 41, 42 are able to determine two transverse limit positions of strip 2, each defined by the switching of signal s1 or s2 when respective sensor 41 or 42 is positioned facing a respective margin of hole 5.

Control unit 8 also receives input signals s3, s4 from a main machine control unit 43, e.g. a PLC type. More specifically, s3 relates to the operating state of the machine (e.g. s3=1 if the machine is operative, s3=0 if the machine is not operative); and s4 is a device 1 enabling signal generated by unit 43 in time with the other operations governed by unit 43, and conveniently varies impulsively from a low-value (s4=0) to a high-value (s4=1) whenever strip 2 is stopped with a hole 5 facing sensors 41, 42.

Control unit 8 generates an output signal s5 for controlling electric motor 11.

Figure 5:
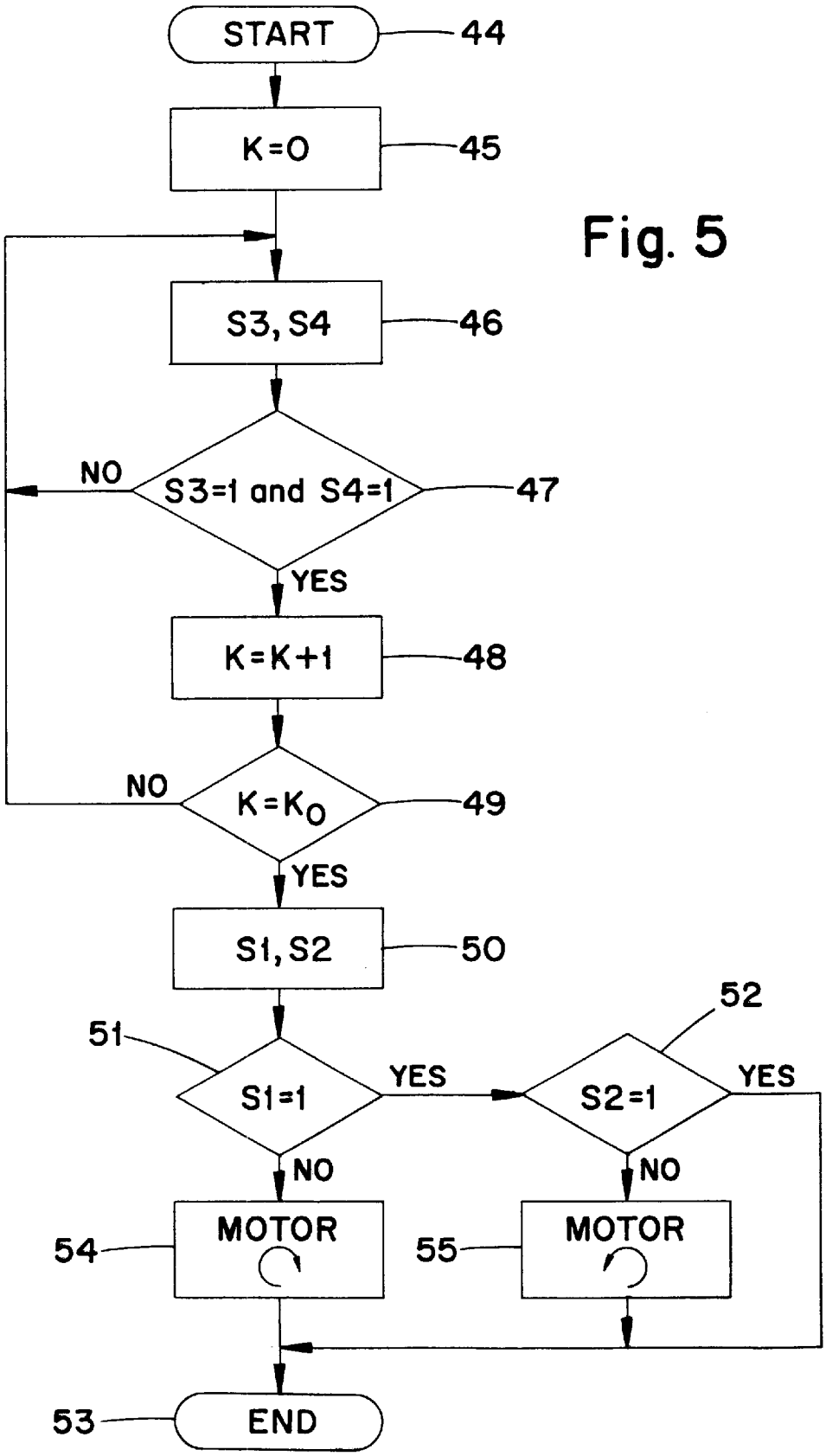
FIG. 5 shows an operating block diagram of a control unit of the FIG. 4 system.

FIG. 5 shows a block diagram of the program performed by control unit 8.

From a start block 44, a first block 45 initializes a counter K, and is followed by an acquisition block 46, which reads the state of signals s3 and s4. Block 46 then goes on to a block 47, which determines whether the state of both signals s3, s4 indicates an enabling condition (e.g. s3=1 and s4=1).

In the event of a negative response, block 47 goes back to block 46. In the event of a positive response, the program goes on to a block 48, which increases counter K, and from block 48 to a comparing block 49, which compares the counter value with a predetermined threshold value $K_o$, e.g. 10.

If K is other than $K_o$, comparing block 49 goes back to acquisition block 46; conversely, if K equals $K_o$, block 49 goes on to an acquisition block 50 to acquire signals s1 and s2 of sensors 41, 42.

The next block 51 detects the state of signal s1. If it is high (sensor 41 inside hole 5), block 51 goes on to a block 52, which determines the state of signal s2. If this is also high (sensor 42 inside hole 5)—thus indicating the strip is positioned between the limit positions—block 52 goes on to an end-of-cycle block 53.

Conversely, if block 51 detects a low-level signal s1 (sensor 41 outside hole 5, thus indicating the first limit position detected by sensor 41 has been exceeded), block 51 goes on to a control block 54, which operates electric motor 11 in such a direction (e.g. clockwise) as to move strip 2 towards the second limit position (rightwards in FIG. 1). Similarly, if block 52 determines a low-level signal s2 (sensor 42 outside hole 5, thus indicating the second limit position detected by sensor 42 has been exceeded), block 52 goes on to a control block 55, which operates electric motor 11 in such a direction (e.g. anticlockwise) as to move strip 2 towards the first limit position (leftwards in FIG. 1).

Operation of device 1, which is already partly obvious from the foregoing description, is as follows. At each stop of strip 2, the main machine control unit 43 supplies a device 1 enabling signal s4. To avoid adjustment oscillation problems, as opposed to all of holes 5, device 1 reads and possibly corrects the position of the holes with a predetermined sampling frequency $1/K_o$ (e.g. one hole every ten).

If either limit position is found to be exceeded, the strip is moved in direction B towards the opposite limit position by operating motor 11 in the "screwing" or "unscrewing" direction of screw 16 inside nut screw 23; and the resulting displacement of slide 12 is transmitted to strip 2 substantially by shoe 29 in the "push" direction (rightwards in the drawings), and by rollers 34 in the "pull" direction (leftwards in the drawings).

The advantages of device 1 according to the present invention will be clear from the foregoing description. In particular, the device provides for automatically adjusting the transverse position of the strip, thus avoiding machine stoppages, production losses or rejects. Moreover, device 1 is cheap and easy to produce, and involves no major alterations of known machines featuring manual adjustment devices.

Clearly, changes may be made to device 1 without, however, departing from the scope of the accompanying Claims.

For example, transmission mechanism 13 may be formed in any other way. In particular, as opposed to rotating screw 16, electric motor 11 may rotate nut screw 23, e.g. by means of a toothed-belt transmission. In which case, screw 16 may be connected rigidly to slide 12 and locked angularly so as to move in response to rotation of nut screw 23. Moreover, sensors 41, 42 may be separated by a distance slightly greater, as opposed to smaller, than the dimension of the holes, so as to "read" strip 2 outside the holes and so generate, for the same operating conditions, signals of opposite states to those described. Sensors 41, 42 may also be assigned optical references of strip 2 other than holes 5, such as one or both of the edges of strip 2, or optical codes printed or formed any other way on the strip.

What is claimed is:

1. A device for adjusting a transverse position of a strip of packaging material on a packaging machine for producing packages containing a pourable food product, the device comprising:

a slide movable in a first direction parallel to a feed plane of said strip and substantially perpendicular to a feed direction of said strip in said plane;

gripping means carried by said slide and for gripping in sliding manner an edge of said strip; and adjusting means for adjusting the position of said slide in said first direction;

characterized in that said adjusting means comprise an actuator for controlling said slide; a first sensor for detecting a first limit position of said strip and generating a first signal; a second sensor for detecting a second limit position of said strip and generating a second signal; and a control unit connected to said first and said second sensors, and which controls said actuator to move said slide towards said second limit position of said strip in response to a value of said first signal indicating said first limit position of said strip has been exceeded, and towards said first limit position of said strip in response to a value of said second signal indicating said second limit position of said strip has been exceeded, said first and said second sensors are optical sensors for detecting optical references of said strip, and said control unit comprising enabling means for enabling detection of said optical references with a predetermined sampling frequency.

2. The device as claimed in claim 1, wherein said actuator is an electric motor; transmission means being interposed between an output member of said motor and said slide.

3. The device as claimed in claim 2, wherein said transmission means comprise a screw-nut screw mechanism.

4. A device for adjusting a transverse position of a strip of packaging material on a packaging machine for producing packages containing a pourable food product, comprising:

a slide movable in a first direction parallel to a feed plane of said strip and substantially perpendicular to a feed direction of said strip in said plane;

gripping means carried by said slide and for gripping in sliding manner an edge of said strip; and adjusting means for adjusting the position of said slide in said first direction;

wherein said adjusting means comprise an actuator for controlling said slide; a first sensor for detecting a first limit position of said strip and generating a first signal; a second sensor for detecting a second limit position of said strip and generating a second signal; and a control unit connected to said first and said second sensors, and which controls said actuator to move said slide towards said second limit position of said strip in response to a value of said first signal indicating said first limit position of said strip has been exceeded, and towards said first limit position of said strip in response to a value of said second signal indicating said second limit position of said strip has been exceeded, said strip being defined by a number of layers, and comprises a succession of holes formed in at least one of said layers and defining optical references of said strip; said first and said second sensor being located facing a portion of said strip having said holes; and said limit positions of said strip being defined by the detection of transversely opposite margins of said holes by said first and said second sensors.

5. The device as claimed in claim 4, wherein said control unit comprises enabling means for enabling detection of said holes with a predetermined sampling frequency.

* * * * *